United States Patent [19]

Zajic et al.

[11] 4,046,678

[45] Sept. 6, 1977

[54] FLOTATION OF SCHEELITE FROM CALCITE WITH A MICROBIAL BASED COLLECTOR

[76] Inventors: James Edward Zajic, 25 Redford Road, London, Ontario, Canada; Naim Kosaric, E.T.H. Technisch Chemisches Laboratorium, Universitatstrasse 6, 8006 Zurich, Switzerland

[21] Appl. No.: 611,719

[22] Filed: Sept. 9, 1975

[51] Int. Cl.[2] ..... B03D 1/02

[52] U.S. Cl. ..... 209/166; 75/2; 210/7

[58] Field of Search ..... 209/164, 166, 167, 171, 209/9; 210/7; 75/2, 10, 12; 423/53

[56] References Cited

U.S. PATENT DOCUMENTS

| | | | |
|---|---|---|---|
| 2,368,055 | 1/1945 | Walker | 210/7 |
| 3,356,609 | 12/1967 | Bruemmer | 210/7 |
| 3,642,615 | 2/1972 | Wieteng | 210/7 |
| 3,721,604 | 3/1973 | Silver | 195/28 R |
| 3,796,308 | 3/1974 | McIlhinney | 209/171 X |
| 3,915,391 | 10/1975 | Mercade | 209/166 X |
| 3,915,854 | 10/1975 | Torpey | 210/7 X |
| 3,937,520 | 2/1976 | Sievert | 75/101 R X |

OTHER PUBLICATIONS

Chem. Abst., 80, p. 274, 87261J, 1974.

*Primary Examiner*—Robert Halper
*Attorney, Agent, or Firm*—Hirons and Rogers

[57] ABSTRACT

Separation of calcite ore from other more valuable minerals such as scheelite (calcium tungstate) is effected by a flotation process in which there is used a flotation aid or frother, and a microbial based collector which is produced by growing a culture or mixture of cultures selected from the genus Pseudomonas and/or the genus Alcaligenes, on a hydrocarbon substrate.

9 Claims, 2 Drawing Figures

FLOTATION OF SCHEELITE FROM CALCITE WITH A MICROBIAL BASED COLLECTOR

BACKGROUND OF THE PRESENT INVENTION

In minerals separation processes for the concentration of a mineral from a low grade ore, one of the most important methods is flotation. The method is based upon the selective separation of components in an aqueous medium by causing one or more of them to float above the slurry of pulverised ore and water. There is added to the slurry a flotation agent or frother, and a collector, under agitation. The frother causes formation of bubbles or frother, which rise to the surface of the aqueous slurry, and the collector aids in causing contact between the particulate solids and the froth, so that the solids of the mineral which it is desired to separate attach to the froth and float on top of the slurry. The type of collector chosen depends upon the nature of the mineral it is desired to separate.

Calcite ($CaCO_3$) a low grade ore, is ore, is found along with many more valuable minerals, but is in many instances particularly difficult to separate from other minerals by a froth flotation process. For example, calcite is found in conjunction with the valuable tungsten ore scheelite ($CaWO_4$). However, serious difficulties have been encountered in separating and concentrating these two materials, since they both float together in froth flotation processes previously practiced. Although calcite can be eliminated from the mixed concentrate of these materials by acid leaching, such a process is too expensive for economic use on a commercial scale. The separation of calcite from scheelite is thus a major and difficult process step in producing high yields of scheelite.

BRIEF DESCRIPTION OF THE PRIOR ART

In a commercial process of treating calcite and scheelite mixed ores to obtain the tungsten values, as hereinafter described in more detail, a concentrate is obtained which contains about 38% tungsten trioxide (as scheelite, calcium tungstate) and about 50% calcite. Numerous reagents have been proposed in the past for use in a flotation process to increase the flotation selectivity and hence effect separation of the tungsten values from the calcite. Examples of such reagents include water glass, basic dyes, tannins, sulfonated products, metallic salts and fluosilicic acids. Processes using these reagents have not however been found commercially acceptable, either because of low recovery of the mineral values or because of low concentration of scheelite in the recovered fraction. Whilst pre-roasting of the ores at high temperature improves the efficiency of the flotation process, its cost is considerable and even prohibitive.

BRIEF SUMMARY OF THE INVENTION

It is an object of the present invention to provide a new and improved process for separating calcite from scheelite.

It is another object to provide a novel process for separating calcite from scheelite by flotation, using collectors produced by a simple microbiological process.

It is another object to provide novel products useful as collectors in the froth flotation separation of calcite from scheelite.

Briefly, according to the present invention, it has been found that certain products of the microbiological process of growing cultures of genus Pseudomonas or the genus Alcaligenes or mixtures thereof in aqueous fermentation broth using hydrocarbons as the substrate, are very efficient as collectors, for separating scheelite from calcite in a froth flotation process, used in conjunction with a flotation aid or frother.

Thus according to the present invention, there is provided a process of separating calcite mineral ore from a mixture of calcite and at least one other mineral ore by a flotation process, which comprises treating an aqueous slurry of the mineral mixture with a flotation aid and a microbial based collector, said collector being a product of the aerobic fermentation of a hydrocarbon substrate and a mixture of cultures including at least one culture of the genus Pseudomonas or the genus Alcaligenes, in an aqueous fermentation medium.

The collector used in the process of the present invention is produced microbiologically, by the aerobic fermentation of cultures of the genus Pseudomonas and/or Alcaligenes on a hydrocarbon substrate. Preferred hydrocarbon substrates are liquid aliphatic hydrocarbons having from 10 to 18 carbon atoms, although aromatic hydrocarbons can also be used. A most preferred source of hydrocarbon substrate is kerosene, containing predominantly aliphatic hydrocarbons having from 11 to 16 carbon atoms, namely undecane, dodecane, tridecane, tetradecane, pentadecane and hexadecane.

According to another aspect of the invention, there is provided a process of separating calcite ore and scheelite ore by flotation of an aqueous slurry mixture of calcite and scheelite ores, which comprises:

growing under aerobic conditions in an aqueous fermentation medium containing mineral salts and a hydrocarbon substrate at least one microbial culture of the genus Alcaligenes or the genus Pseudomonas to obtain a fermentation broth containing products of said hydrocarbon fermentation;

adding a product of said hydrocarbon fermentation as collector, along with a frother comprising a surface active substance, to the aqueous slurry mixture of calcite and scheelite;

aerating the aqueous slurry mixture, collector and frother to cause frothing and flotation of the slurry;

collecting the floated portion of the slurry mixture by overflow means.

DESCRIPTION OF THE PREFERRED EMBODIMENTS

In preparing the collector, it is preferred to use a mixed culture system which will grow on the hydrocarbon substrate. The collector is thus prepared by growing the culture system by injecting the culture system into an aqueous medium containing simple mineral salts and containing the hydrocarbon. The actual conditions of fermentation will be readily devised by those skilled in the art, to effect growth of the culture and consumption of the hydrocarbon substrate. The fermentation will take place over a wide range of environmental conditions and in very simple media. It is desirable that the mineral salts in the medium include a carbonate or a phosphate to effect some buffering activity, although the process can be worked over a fairly wide pH range, e.g. from pH6 to pH10. The fermentation is aerobic, and it is preferred that the medium have an oxygen content of from 0.1 to 30 mg/liter. In practice, air is supplied continuously to the medium during the process, to provide the necessary oxygen content. The preferred temperature of operation of the process is from about 5° C to about 55° C, the most preferred temperatures being from 25° C to 37° C. If desired, vitamin supplements such as yeast extract or beef extract can be added to the culture growth medium. This fermentation takes place normally for a period of about 12 hrs. - 21 days. The product can be produced on a batch or continuous basis.

Suitable sources of microbial cultures for use in preparing the collector are raw sewage, oil-soaked soil, and water which has stood in contact with oil. It is preferred to enrich the cultures, to remove at least in part those in the microbial sources which do not grow only to a slight extent on a hydrocarbon substrate. This enrichment may be done by growing the cultures aerobically in an aqueous mineral salt medium in the presence of a hydrocarbon substrate, and subsequently extracting a small portion of the culture broth and using it to inoculate another similar batch system. By such a process, the culture broth becomes enriched in those cultures growing and multiplying on the hydrocarbon substrate, at the expense of the non-growing cultures in the system. The culture broth of the second batch, after growth for a period of time, can be used as the source of enriched microorganisms to prepare the collector for use in the present invention.

Thus, in a preferred process according to the invention, a culture source such as raw sewage, oil soaked soil or water which has stood in contact with oil is grown in a first fermentation stage, in an aqueous mineral salt medium containing at least one metal carbonate or at least one metal phosphate, at a pH of from about 6 to about 10, under aerobic conditions, at a temperature of from about 5° to about 55° C, the medium containing a hydrocarbon substrate comprising liquid aliphatic hydrocarbons having from 10 to 18 carbon atoms in an amount of from about 0.5% to 5% by volume of the medium, for a period of from about 12 hrs. to about 21 days, so as to produce a first culture broth enriched in microorganisms from said culture source which grow upon said hydrocarbon substrate. Then, the first culture broth so formed is used to inoculate, in a second fermentation stage, an aqueous mineral salt medium containing at least one metal carbonate or at least one metal phosphate, at a pH of from about 6 to about 10, under aerobic conditions, at a temperature of from about 5° C to about 55° C, the medium containing a hydrocarbon substrate comprising liquid aliphatic hydrocarbons having from 10 to 18 carbon atoms per molecule in an amount of from about 0.5% to 5% by volume of the medium, for a period of about 12 hrs. to about 21 days, so as to produce a second culture broth further enriched in micro-organisms which grow upon said hydrocarbon substrate. This second culture broth may be used as the collector or the source of the collector in the flotation process of the invention. Alternatively, the fermentation process may be repeated one further time, inoculating another similar aqueous mineral salts medium containing similar hydrocarbon substrate, under similar conditions and continuing the fermentation for a period of from 12 hrs. to 21 days so as to produce a fermentation broth useful as a collector as a process of the invention, or containing ingredients useful as collectors in the process of the invention.

Two separate and distinct microbial cultures which are involved in the production of the collector have been isolated. These are a culture isolate of the genus Alcaligenes, probably of the speciies Alcaligenes faecalis, and a culture isolate of the genus Pseudomonas, according to the classification of "Index Bergeyana". These have been deposited in the University of Western Ontario Culture Collection (Plant Science) and have been designated respectively cultures numbers VW0455 and VW0456.

The collector which is used in the process of the present invention may comprise the entire product of the fermentation process, i.e. the entire fermentation broth, or certain selected parts of it. After fermentation to produce the collector, the resultant broth comprises a liquid phase containing dissolved or dispersed products and solid phases. If desired it can be used per se as the collector, or it can be separated, e.g. by centrifugation and extraction, and certain of its separated parts used as the collector. Upon centrifugation, the broth can be separated into sediment, composed largely of cells, supernatant liquid containing dissolved or dispersed products of a high molecular weight nature, and floating solids material. The supernatant liquid material, the dissolved or dispersed products therein and the floating solids material can all be used, separately or in admixture, as the collector. The cells alone are not, however, effective. The floating solids material, whilst useful, is less effective than others of the components.

In a preferred process according to the invention, the collector material is treated prior to adding it to the mineral slurry, by heating it to within the approximate range of from about 70° C to its boiling point and cooling it to room temperature prior to use, and/or adjusting its pH to about 10.0 to 11.5. It has been found that the efficiency of the microbially produced collector in effecting minerals separation is increased by such treatment.

The fermentation broth as a whole may be subjected to such activating treatment and then used per se as collector material. Alternatively, the fermentation broth may be subjected to such activating treatment, and then separated into its constituent parts as described above, and one or more of the constituent parts used as collector material. As a further alternative, the fermentation broth may be separated into its constituent parts as described above, and those of its parts which it is desired to use as the collector material subjected to such activating treatment.

As noted, the process of the present invention uses a collector as described above, in conjunction with a frother. The frothers which may be used are those commonly used in the minerals froth flotation separation process, and are surface active substances. Specific examples include cresylic acids, pine oil, alcohols, methyl isobutyl carbinol (MIBC) or complex fatty acid amine sulphates. The most preferred frother for use in the present invention is the complex fatty acid amine sulphate available under the trade name EMCOL 4150.

The actual conditions under which the flotation process of the present invention is carried out are generally in accordance with known ore flotation processes of the prior art. Thus, the frother is used normally in amounts of from about 0.1 to 5 parts by volume per 100 parts by volume of aqueous mineral slurry. The collector is used in amounts of from about 0.5 to about 10 parts by volume per 100 parts by volume of slurry. In the process, it is preferred firstly to adjust the acidity of the aqueous mineral slurry, to a pH of from about 6 - 12, with acid or alkali (normally hydrochloric acid or caustic soda) as necessary. After mixing in the acid or alkali, the collector is then added to the slurry in the flotation vessel, the mixture is left to stand or condition for a brief period (e.g. one-half - 3 minutes). Then the frother is added to the slurry-collector mixture, and a further brief conditioning period (e.g. one-quarter - 2 minutes) is allowed. Air is then blown through the aqueous mixture in the flotation vessel to cause frothing and flotation, and the overflow material is collected. The temperature of the flotation process is not critical, and can be anywhere within the range from about 5° C to about 75° C, as convenient The process of the present invention lends itself well to industrial application. Minerals separation processes are generally conducted adjacent to the site of the mineral mine. Since the microbiological process for producing the collector for use in the present invention is simple to perform and uses readily available culture sources and fermentation raw materials, it is easily conducted in vessels alongside the ore processing facilities, and integrated into the ore extraction and separtion process steps. On site production of the collector material in this way avoids problems of transportation of the collector, which in many cases comprises a very high water content.

The invention is further described and illustrated below with reference to the accompanying drawings and specific examples.

BRIEF DESCRIPTION OF THE DRAWINGS

Scheelite, calcium tungstate, is a heavy yellowish, or brown-purple mineral having a specific gravity from about 5.4 to 6.1. It is found in igneous rock usually with granite. The ore typically contains about 1.7% tungsten trioxide as calcium tungstate, 0.25% chalcopyrite (cuprous sulfide) and 7% iron sulfides. With reference to FIG. 1, the ore is crushed and ground to minus 65 mesh and mixed with water to form a pulp of about 55% solids content. The pulp is subjected to a conventional flotation process in which the copper ores are separated and recovered. The residual pulp tailings are then subjected to flotation to remove mineral sulfides. The tailings from sulfide flotation which contain an average of 2.6% of $WO_3$ are further subjected to gravity concentration by tabling. Subsequent roasting and magnetic separation of cleaned table concentrates produce a high quality product containing an average of 76% $WO_3$ at a recovery rate in excess of 50% of the $WO_3$ contained in the ore. Tailings from the tabling containing about 1.0% $WO_3$ are then subjected to flotation at 35% solids for recovery of fine scheelite.

Figure 1:
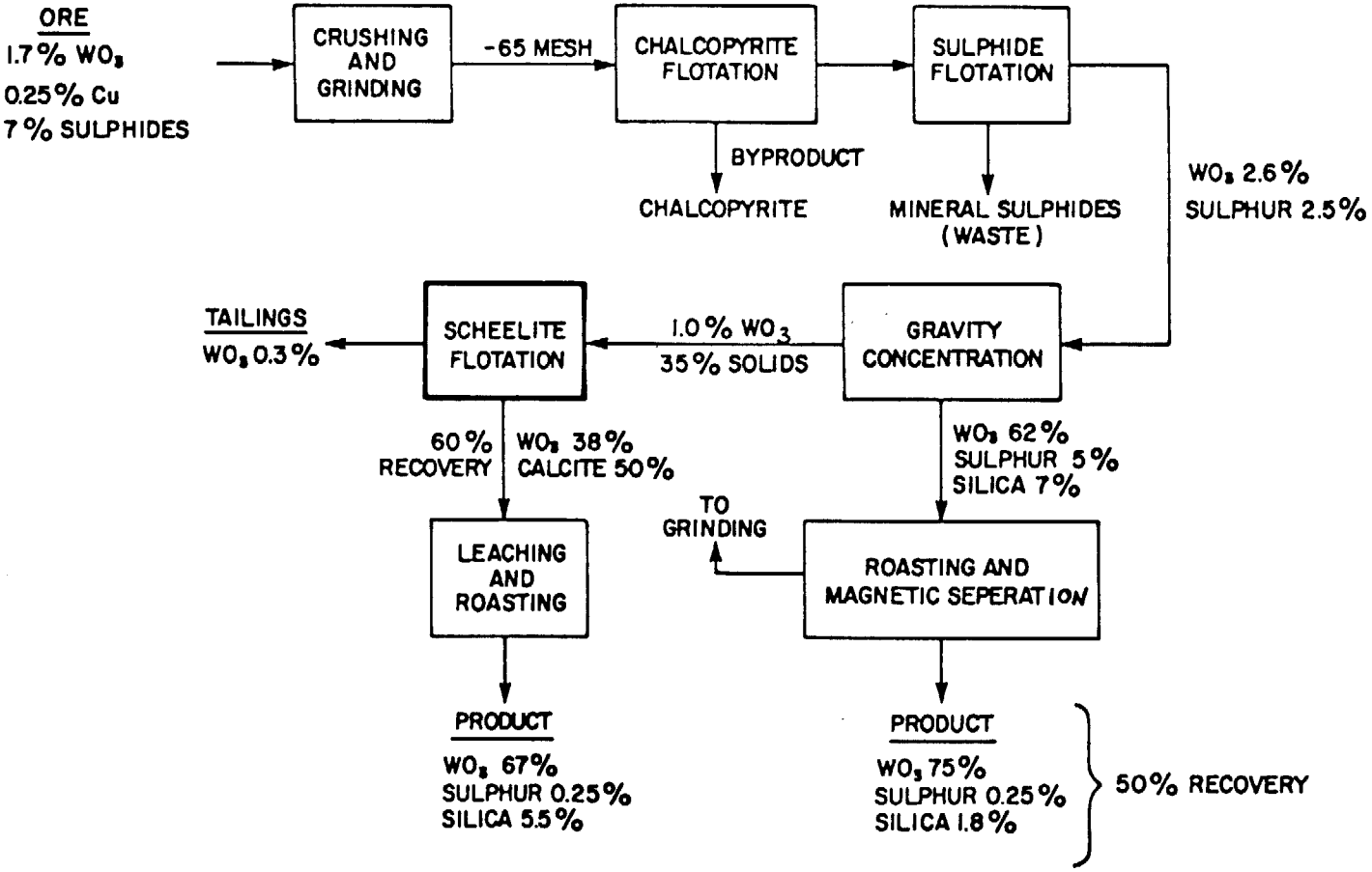
FIG. 1. PRIOR ART
FIG. 1 is a diagrammatic process flow sheet of a known commerical process for obtaining tungsten values from scheelite ore.

It is a major problem in scheelite flotation to separate calcite from tungstate since they both float together during the scheelite flotation process. As illustrated, the prior art process obtains a flotation concentrate containing about 38% $WO_3$ and 50% calcite. Acid leaching of the concentrate has now to be used, but this process is not economical. The present invention relates to the scheelite flotation step of the illustrated process.

EXAMPLE 1

In this example, a microbial based collector was prepared by fermentation, for use in a calcite-scheelite flotation separation process.

A mixed culture system was used, the system consisting primarily of bacteria that were enriched from oil soaked soil from the area of Sarnia, Ontario, provided by Imperial Oil Enterprises Limited, Sarnia, Ontario.

The microorganisms were enriched in a simple mineral salts medium containing kerosene as the carbon source at a concentration of 2 percent by volume. The kerosene contained decane, undecane, dodecane, tridecane, tetradecane and pentadecane. The do-, tri- and tetradecane are the predominant paraffins in this kerosene. The incubation medium had the following composition by weight:

| | |
|---|---|
| Sodium Nitrate | 0.4% |
| Potassium Hydrogen Phosphate | 0.5% |
| Potassium Dihydrogen Phosphate | 0.2% |
| Magnesium Sulphate | 0.02% |
| Sodium Chloride | 0.01% |
| Yeast Extract | 0.3% |

the balance of the medium was tap water. The pH of the medium was 6.9-7.0. The medium was prepared by using reagent grade chemicals.

Enrichments were conducted in one liter Spinner Flasks containing 950 ml of mineral salt medium and 20 ml of kerosene. Air was supplied by a single tube sparger at the rate of 100 ml per minute. Normally, flasks were incubated for 10 - 14 days at room temperature (24° ± 3° C) under aseptic batch conditions. Subsequently, 30 ml of culture broth was used to inoculate another similar batch system. This system, operating for about 14 days, produced a second culture broth which represented the source of enriched microorganisms which were used for further inoculation for the shake flask experiments.

Shake flask experiments were conducted in 500 ml Erlenmeyer flasks containing 95 ml of the medium described above and 2 ml of kerosene. To this was added 3 ml of culture inoculm, prepared as mentioned above. The whole mixture was incubated on a New Brunswick Gyrotary Tier Shaker Model G53 for 6 to 10 days under aseptic conditions. Agitation was at 200 rpm and the temperature of incubation was 25° ± 2° C. The pH of the system increased from 7.0 to about 8.0 after 10 to 14 days of fermentation. The resultant fermentation broth was then used for flotation experiments in subsequent examples, as described below.

EXAMPLE 2

In this example, a series of laboratory experiments was conducted to separate scheelite and calcite contained in an aqueous slurry using as frother EMCOL 4150 and as collector the fermentation broth produced according to Example 1.

A one liter flotation cell was employed. A mixture of pure calcium tungstate ($CaWO_4$) and calcium carbonate ($CaCO_3$) (50 grams of each) was added to the flotation cell and tap water was used to obtain a slurry volume of 950 ml. The pH of the slurry was adjusted to the desired value (either by 1 N hydrochloric acid or by 1 N sodium hydroxide), the slurry pH being different in various experiments. Then 50 ml of the culture broth (with pH adjusted to 10.2 by 1 N sodium hydroxide) as collector was heat treated by heating on a hot plate up to 80° C and cooled to room temperature. This treated broth was used as collector and added to the slurry. Ninety seconds were allowed for conditioning at an impeller speed of 1000 rpm. 0.25 ml of EMCOL 4150 was used as the frother. Fortyfive seconds were allowed for conditioning. Then the slurry was floated for 4 - 5 minutes by providing an adequate amount of air. The amount of air introduced into the cell was the minimum amount required to obtain a slurry overflow from the cell. The overflow was collected, filtered and heat dried at 100° C. The weight of the material in the overflow was determined. The calcium carbonate in the overflow was dissolved by dilute hydrochloric acid. The remaining calcium tungstate was filtered off, dried and weighed. The recovery percentages of calcium tungstate and calcium carbonate from the feed were then calculated. The results are given in Table I

TABLE 1

| Slurry pH | Percent Recovery | | Percent in Overflow Concentrate | |
|---|---|---|---|---|
| | $CaWO_4$ | $CaCO_3$ | $CaWO_4$ | $CaCO_3$ |
| 6.5 | 62.2 | 54.5 | 53.3 | 46.7 |
| 7 | 76.2 | 66.6 | 53.4 | 46.6 |
| 8 | 79.3 | 66.2 | 54.5 | 45.5 |
| 9 | 77.6 | 62.7 | 55.3 | 44.7 |
| 10 | 80.0 | 63.7 | 55.7 | 44.3 |
| 10.5 | 82.8 | 73.9 | 52.9 | 47.1 |
| 11 | 93.2 | 89.6 | 51 | 49 |

These results indicate that the optimum recovery of calcium tungstate and the best separation of the two components was obtained when the slurry pH was adjusted to around 9.5–10.0. The recovery were 80 and 64 for calcium tungstate and calcium carbonate respectively with the slurry at pH 10. This is a very significant difference in recovery percentages, and indicates that separation of the two materials can be accomplished in this manner, with adequate recycle of the overflow through another similar flotation process.

For control purposes, a similar series of flotation experiments was run, but omitting the culture broth and just using the EMCOL 4150 frother, at a series of slurry pH values from 7.0 to 10. The results are given in Tabe II, and show that both calcium carbonate and calcium tungstate were virtually 100% recovered in the froth so that no separation of the two components was effected.

TABLE II

| Slurry pH | Percent Recovery | | Percent in Overflow Concentrate | |
|---|---|---|---|---|
| | $CaWO_4$ | $CaCO_3$ | $CaWO_4$ | $CaCO_3$ |
| 7 | 98.6 | 99.4 | 49.8 | 50.2 |
| 8 | 99.7 | 99.3 | 50.1 | 49.9 |
| 9 | 98.7 | 99.4 | 49.9 | 50.1 |
| 10 | 99.5 | 98.8 | 50.2 | 49.8 |

Figure 2:
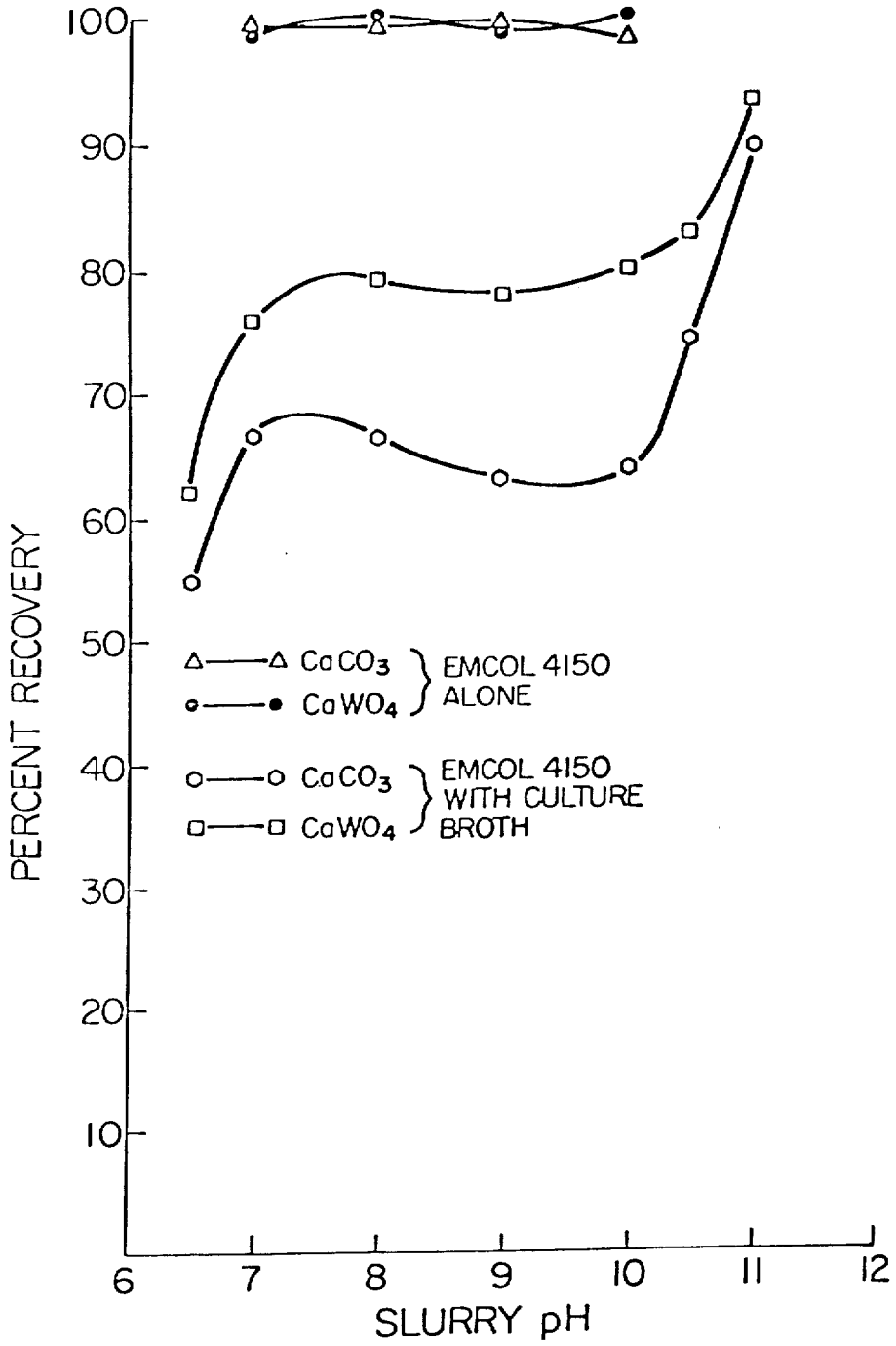
FIG. 2 is a graphical presentation of results of specific experiments described hereinbelow.

The results of Example 2 are also presented graphically in FIG. 2, which is a plot of slurry pH value as horizontal axis against percent recovery of material as vertical axis.

The microorganisms in the mixed culture systems using this example were identified as Gram-negative bacteria containing species of Pseudomonas and Alcaligenes.

EXAMPLE 3 — CONTROL

For comparison and control purposes, a series of flotation separation experiments were conducted using as collector, instead of fermentation broth, an industrial flotation collector "Pamak" (tall oil fatty acids) together with EMCOL 4150 frother. The slurry pH was adjusted to 10. The experiment was conducted as described in Example 2. The results are given in Table III, and indicate that this system was not selective for either calcium tungstate or calcium carbonate. Both components were virtually 100% recovered in the flotation liquid, giving no differential separation of the component materials.

TABLE III

| Drops of Pamak Used | Percent Recovery | | Percent in Overflow Concentrate | |
|---|---|---|---|---|
| | $CaWO_4$ | $CaCO_3$ | $CaWO_4$ | $CaCO_3$ |
| 3 | 98.7 | 97.2 | 50.4 | 49.6 |
| 5 | 99.2 | 98.0 | 50.3 | 49.7 |
| 7 | 99.8 | 98.7 | 50.3 | 49.7 |

EXAMPLE 4

In this example, a series of flotation separation experiments were conducted as previously described, to separate calcium carbonate from calcium tungstate using EMCOL 4150 as frother, but using as collector various portions of the fermentation broth produced as described in Example 1.

Thus, 50 mls of activated culture broth (i.e. broth which had been heated to 80°–100° C and cooled to room temperature, and its pH adjusted to about 10.0 to 11.5) was separated into several fractions either by physical or chemical means. Then each friction, or a combination of two such fractions, was used as a collector with 0.25 ml of frother EMCOL 4150 to test the selectivity in flotation. The flotation separation experiments were carried out using flotation cells, according to the procedure described in example 2.

Eight runs were performed, as follows:

Run A:— whole, "activated culture broth" was used as flotation agent;

Run B:— cells obtained by centrifuging the whole "activated culture broth" were suspended in distilled water and used as a flotation agent;

Run C:— a material, floating on the top of the centrifuged supernatant, herein after designated as "floating material"was used. The floating material was re-suspended in distilled water before use;

Run D:— clear centrifuged supernatant liquid, without "floating material" was used as flotation agent;

Run E:— "floating material" was re-suspended in the supernatant and used as such;

Run F:— fats extracted from the supernatant by three volumes of ethyl alcohol and chloroform (1:3) were mixed with the "floating material" which was re-suspended in distilled water and this mixture was used as a flotation agent;

Run G:— a precipitate formed from the supernatant liquid by the addition of two volumes ethyl alcohol, was dissolved in distilled water in which the "floating material" was re-suspended and this mixture was used as a flotation agent;

Run H:— the precipitate obtained from the supernatant liquid by the addition of two volumes of ethyl alcohol was redissolved in distilled water and used alone as a flotation agent.

The results of these test are given in Table IV.

TABLE IV

| | Activated Culture Broth Fraction as Collector | Percent Recovery | | Percent in Overflow Concentrate | |
|---|---|---|---|---|---|
| | | $CaWO_4$ | $CaCO_3$ | $CaWO_4$ | $CaCO_3$ |
| A | Whole Activated Culture Broth | 95.3 | 30.1 | 76.0 | 24.0 |
| B | Cells Only | 99.2 | 98.2 | 50.3 | 49.7 |
| C | Floating Material | 99.8 | 71.3 | 58.3 | 41.7 |
| D | Supernatant Only | 99.0 | 61.1 | 61.8 | 38.2 |
| E | Supernatant Plus | | | | |

TABLE IV-continued

| | Activated Culture Broth Fraction as Collector | Percent Recovery | | Percent in Overflow Concentrate | |
|---|---|---|---|---|---|
| | | $CaWO_4$ | $CaCO_3$ | $CaWO_4$ | $CaCO_3$ |
| | Floating Material | 96.7 | 37.7 | 71.9 | 28.1 |
| F | Fat (Supernatant) Plus Floating Material | 99.3 | 78.7 | 55.8 | 44.2 |
| G | Precipitate (Supernatant) Plus Floating Material | 96.7 | 22.1 | 81.4 | 18.6 |
| H | Precipitate (Supernatant) Only | 99.4 | 48.0 | 67.4 | 32.6 |

The data indicates that the precipitate obtained by ethanol threatment of the supernatant liquid was found to have the highest separation selectivity. All of the various fractions except the cells alone appear to show some selectivity towards improving calcium tungstate separation from calcite. These results indicate that either the whole culture broth can be used as the collector or flotation agent, or various fractions obtain therefrom can be used, either alone or in combinations.

NATURE OF THE FERMENTATION OF BROTH USED AS A COLLECTOR OR FLOTATION AID.

The precise nature of the constituents of the culture broth which is responsible for the surprisingly good selective flotation results according to the present invention is not known. As indicated in Example 4 and the results given above in Table IV, it seems likely that a material, contained in the supernatant liquid of the culture broth, and extractable therefrom with ethyl alcohol, is in large measure responsible for the selective flotation activity. In addition, however, it appears from the same results that the floating material reported in Example 4, and the fat constituent of the supernatant liquid of the broth are responsible for some degree of the selective flotation activity. Accordingly, analysis of the floating material and of the material precipitated by adding ethyl alcohol to the supernatant liquid was undertaken. Both of these samples were purified by reprecipitation and washing in distilled water.

The purified sample of floating material was analysed for carbon, hydrogen, nitrogen, ash, carbohydrate and amino acids. Carbon and hydrogen in the samples were determined by a combustion method, using a Coleman Carbon-Hydrogen Analyser Model 33. Approximately 10 mg sample was used for each determination. Nitrogen content was determined by combustion of samples according to the Dumas method. For determination of total carbohydrates (TCH), a colorimetic method with anthrone reagent was used. The ash content was determined by weighing approximately 100 mg of sample in a weighed porcelain dish and igniting over a bunsen flame for half an hour. Then the sample was left in a furnace at 60° C for an hour, cooled in a desiccator and weighed. Oxygen content was estimated by difference.

A sample of floating material used in Run C of Example 4 was found to have a total carbohydrate content of 12.2%, and 44.2% proteins. The elemental composition of this material was as follows:

| | |
|---|---|
| Nitrogen | 6.8% |
| Carbon | 55.6% |
| Hydrogen | 8.8% |
| Oxygen | 24.9% |
| Ash | 3.7%. |

For individual carbohydrates, the scample was hydrolyzed for 2 hours with 1 N HCL and analyze by gel filtration chromatography followed by colorimetric reaction with orcinol and compared with a known standard. The sample was found to contain about 4.9% arabinose, 2.5% galacose and 2.4% glucose.

The individual amino acids were determined by a Technicon amino acid analyzer. The sample of floating material was cleaned and freeze dried. The dried material was prepared for amino acid analysis by hydrolysis with 6N hydrochloric acid at 100° C for 24 hrs. in a drying oven. Then it was re-dissolved in buffer at pH 2.0 and analyzed. Most of the conventional amino acids were found to be present in the protein, some such as cystine and ornithine in very low concentration. The individual amino-acid contents are given below in Table V.

TABLE V

Amino Acids Content of Protein Hydrolyzate of "Floating Material"

| Amino Acid | % (w/w) of Total Hydrolyzed Sample |
|---|---|
| Aspartic Acid | 4.60 |
| Threonine | 2.96 |
| Serine | 2.46 |
| Glutamic Acid | 6.08 |
| Proline | 2.55 |
| Glycine | 2.15 |
| Alanine | 3.61 |
| Valine | 3.56 |
| Cystine | 0.02 |
| Methionine | 1.09 |
| Isoleucine | 2.61 |
| Leucine | 3.56 |
| Tyrosine | 1.48 |
| Phenylalanine | 2.29 |
| Histidine | 1.49* |
| Ornithine | 0.08 |
| Lysine | 2.51 |
| ε Methyl Lysine | 0.09 |
| Arginine | 3.95 |

*Includes unknown compound

The precipitate obtained from the supernatant liquid by addition ethyl alcohol was analyzed after purification in a similar way, for carbon, hydrogen, nitrogen, ash, carbohydrate and amino acids. Its elemental composition was as follows:

| | |
|---|---|
| Nitrogen | 0.5% |
| Carbon | 3.5% |
| Hydrogen | 1.5% |
| Oxygen | 9.9% |
| Ash | 84.6%. |

An ultraviolet spectrum of this precipitate was taken, after dissolving 50gms of the purified sample in 40ml of distill water. A Perkin Elmer double beam spectrophotometer was used to obtained a spectrum in the ultraviolet region (370–180 nm). Distilled water was used as a blank sample. Two strong absorption peaks were observed at 255nm and 196nm. The absorption at 255nm is probably related to protein. The absorption at 196nm is expected to be related to metallic salts. Molecular weight determination of the precipitated conducted by gel filtration chromatography using a column of Sephadex G 200 gave two maximun absorptions, corresponding to average molecular weights of about 300,000 and about 13,700

It is known that bacterial attack of hydrocarbons under aerobic conditions leads in some cases to the oxidation of the hydrocarbon to form alcohols, acids and aldehydes.It is possible, therefore, that the effective products present in the fermentation broth, reponsible for the selective flotation of scheelite according to the present invention are long chain, high molecular weight fatty acid compositions. However, further characterization work on these materials has not been concluded to date. The present invention thus resides in the use of the culture broth, either as a whole or selected fractions or combinations thereof, which are useful in effecting selective flotation of scheelite in the presence of calcite, thereby to effect a separation of these ores.

We claim:

1. A process of treating an aqueous slurry of a mixture of calcite mineral ore and scheelite mineral ore by froth flotation process so as to obtain a second mixture of calcite and scheelite in which the relative proportion of scheelite is increased, which comprises adding to said aqueous slurry a surface active frother and a microbial based collector and agitating the slurry to cause frothing thereof, the microbial base collector being a product of the aerobic fermentation of a hydrocarbon substrate and a mixture of cultures including at least one culture of the genus Pseudomonas or the genus Alcaligenes in an aqueous fermentation medium, and recovering from the froth said second mixture of calcite and scheelite containing relatively increased proportion of scheelite.

2. The process of claim 1, wherein said collector is the total fermentation broth produced as a result of said aerobic fermentation.

3. The process of claim 2, wherein the fermentation broth is activated prior to treating the aqueous mineral slurry therewith, by heating it to a temperature of from about 80° C to about 100° C and cooling to room temperature, and adjusting its pH to about 10.0 to about 11.5.

4. The process of claim 1, wherein the collector is a portion of the product of said fermentation which includes a high molecular weight product thereof which is soluble in the aqueous fermentation broth.

5. The process of claim 1, wherein the surface active frother comprises complex fatty acid amine sulfates.

6. A process of obtaining from a first aqueous slurry mixture of calcite ore and scheelite ore by froth flotation a second aqueous slurry mixture of calcite and scheelite ores, having an increased relative proportion of scheelite ore, which comprises:

growing under aerobic conditions in an aqueous fermentation medium containing mineral salts and a hydrocarbon substrate at least one microbial culture of the genus Alcaligenes or the genus Pseudomonas to obtain a fermentation broth containing products of said hydrocarbon fermentation;

adding a product of said hydrocarbon fermentation as collector, and adding a frother comprising a surface active substance, to the first aqueous slurry mixture of calcite and scheelite;

aerating the first aqueous slurry mixture, collector and frother to cause frothing and flotation of the slurry;

and collecting the floated portion thereof comprising a second slurry mixture containing an increased proportion of scheelite ore relative to calcite ore, as compared with said first slurry mixture.

7. The process of claim 6 wherein the hydrocarbon substrate on which the microbial culture is grown is a mixture comprising C10 - C18 aliphatic hydrocarbons.

8. The process of claim 7 wherein the microbial culture growth takes place in a plurality of fermentation stages starting from a mixed culture system, the first said fermentation stage comprising an aerobic fermentation of the mixed culture source in an aqueous mineral salt medium in the presence of said hydrocarbon substrate to produce a first culture broth enriched in microorganisms from said culture which grow upon said hydrocarbon substrate, a subsequent fermentation stage comprising an aerobic fermentation of a portion of said first culture broth on said hydrocarbon substrate in an aqueous mineral salt medium, to produce a second culture broth for use as collector or as source of collector for the flotation step.

9. The process of claim 6 including the step of activating the products of said hydrocarbon fermentation by heating them to a temperature of from about 70° C to the boiling point thereof, cooling to room temperature, and adjusting the pH thereof to about 10.0 to 11.5, prior to adding said products as collector to the first aqueous slurry mixture.

* * * * *